US005584191A

United States Patent [19]

Kwon

[11] Patent Number: 5,584,191

[45] Date of Patent: Dec. 17, 1996

[54] COOL AIR SUPPLY APPARATUS OF REFRIGERATOR

[75] Inventor: Young-Chul Kwon, Seoul, Rep. of Korea

[73] Assignee: Goldstar Co., Ltd., Rep. of Korea

[21] Appl. No.: 370,751

[22] Filed: Jan. 10, 1995

[30] Foreign Application Priority Data

Jan. 10, 1994 [KR] Rep. of Korea ..... 1994-321

[51] Int. Cl.[6] ..... F25D 17/04

[52] U.S. Cl. ..... 62/417; 62/407; 62/440; 62/255

[58] Field of Search ..... 62/255, 407, 417, 62/418, 419, 426, 452, 455; 454/195

[56] References Cited

U.S. PATENT DOCUMENTS 5,319,937 6/1994 Fritsh et al. ..... 62/455

*Primary Examiner*—John M. Sollecito
*Attorney, Agent, or Firm*—Spencer & Frank

[57] ABSTRACT

This invention relates to a cool air supply apparatus for maintaining a homogeneity of cool air distribution in a cold-storage room includes a cool air guiding part for guiding cool air generated from a compressor to the cold-storage room and a cool air spouting part (104, 107, 109) having multiple spouting holes (104' and 109') for spouting the cool air supplied from the cool air guiding part from the walls and door of the cold-storage room.

4 Claims, 4 Drawing Sheets

COOL AIR SUPPLY APPARATUS OF REFRIGERATOR

FIELD OF THE INVENTION

The present invention relates to a refrigerator, more particularly to a cool air supply apparatus for maintaining a homogeneity of cool air distribution in a cold-storage room.

BACKGROUND OF THE INVENTION

FIG. 1 is a schematic diagram of a conventional refrigerator to describe fluctuation of cool air. As shown in FIG. 1, the conventional refrigerator comprises a fan motor 1 circulating compulsorily cool air which is generated from a compressor, a cool air duct 2 inducing circulation of the cool air to the cold-storage room, a guiding duct 3 controlling an suction quantity of the cool air being moved to the cold-storage room by opening and closing a hole equipped thereto, and a multi-duct 4 spouting out the cool air supplied from the above guiding duct 3 to each portions of the cold-storage room.

FIG. 2 is a cross-sectional view of the refrigerator taken along line A—A' in FIG. 1 and FIG. 3 is a detailed view of the above multi-duct, where 3A is a front view and 3B is a side view respectively.

As shown in the drawings, the multi-duct 4 has a cool air spout holes 5 for spouting cool air, which is formed at the front portion of it.

Referring to FIG. 1, 2 and 3, there is illustrated a cooling method of the conventional cooling apparatus.

First, cool air generated from the compressor is compulsorily circulated by the fan motor 1 and moved to the cold-storage room through the cool air duct 2 and the guiding duct 3. The quantity of the cool air being introduced to the cold-storage room is controlled by the opening and closing of a exhaustion hole (not shown) of the guiding duct 3 according to the temperature sensing of the cold-storage room. The cool air is flowed into the multi-duct 4 in the cold-storage room and is spouted out the inside of the cold-storage room.

At this time, as shown in FIG. 2, since the cool air is introduced from not only the multi-duct but also the upper portion of the cold-storage room, the vicinity of the side walls, the upper portion and the inside(A region) of the cold-storage room are easily cooled and over-cooled, whereas the door portion (C, D regions) is not cooled easily because there is a long distance from the cooling supply sources and a external heat is easily penetrated due to the opening of the door. Accordingly, the foods positioned at the vicinity of the door go bad easily.

SUMMARY OF THE INVENTION

The object of this invention is to provide a cool air supply apparatus capable of preserving foods at appropriate temperature regardless of the position of the foods put in the cold-storage room.

This and other objects can be achieved by a cool air supply apparatus of a refrigerator comprising a cool air guiding part for guiding cool air generated from a compressor to the cold-storage room and cool air spouting means for spouting the cool air supplied from the cool air guiding part from the walls and door of the cold-storage room.

BRIEF DESCRIPTION OF THE DRAWINGS

FIG. 1 is a schematic diagrams of the conventional refrigerator to describe a fluctuation of cool air, where

FIG. 3 is a schematic diagrams of the multi-duct, where

DETAILED DESCRIPTION OF THE INVENTION

Figure 1A:
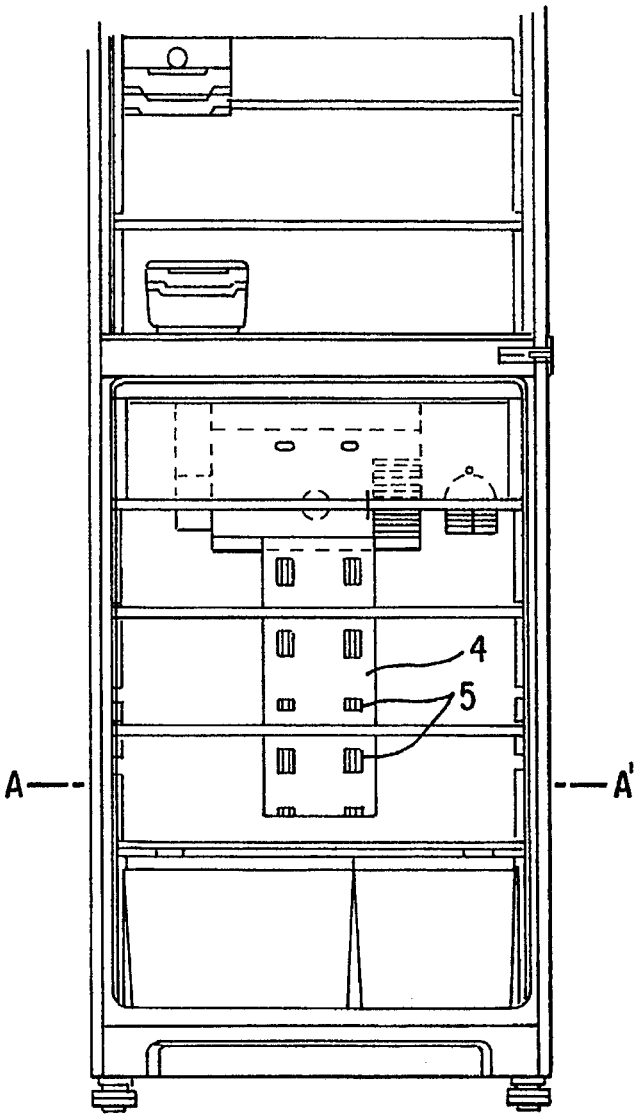
FIG. 1A PRIOR ART
FIG. 1A is a front sectional view and FIG. 1B is a side sectional view.
Figure 1B:
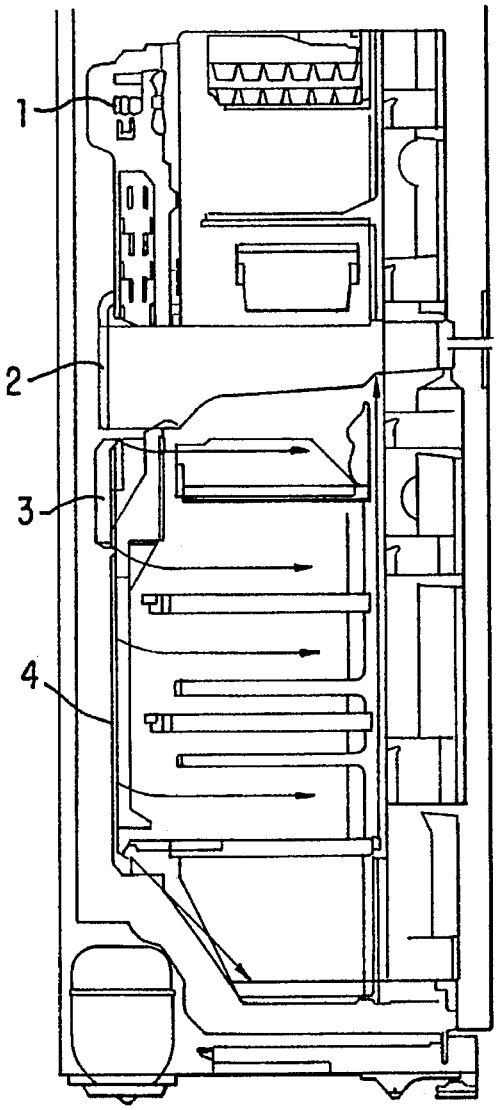
FIG. 1B PRIOR ART
Figure 2:
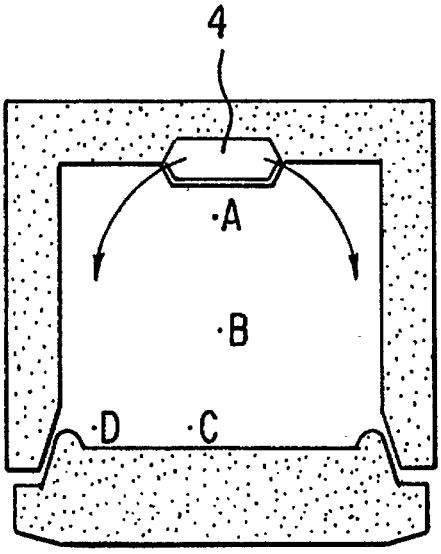
FIG. 2 is a side sectional view of a cold-storage room taken along line A—A' of FIG. 1A.
Figure 3A:
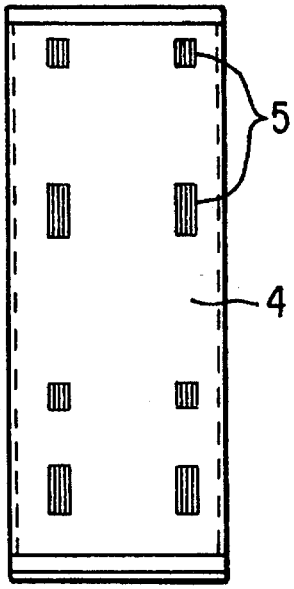
FIG. 3A is a front view and FIG. 3B is side view of it respectively.
Figure 3B:
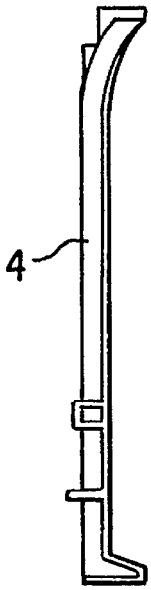
Figure 4:
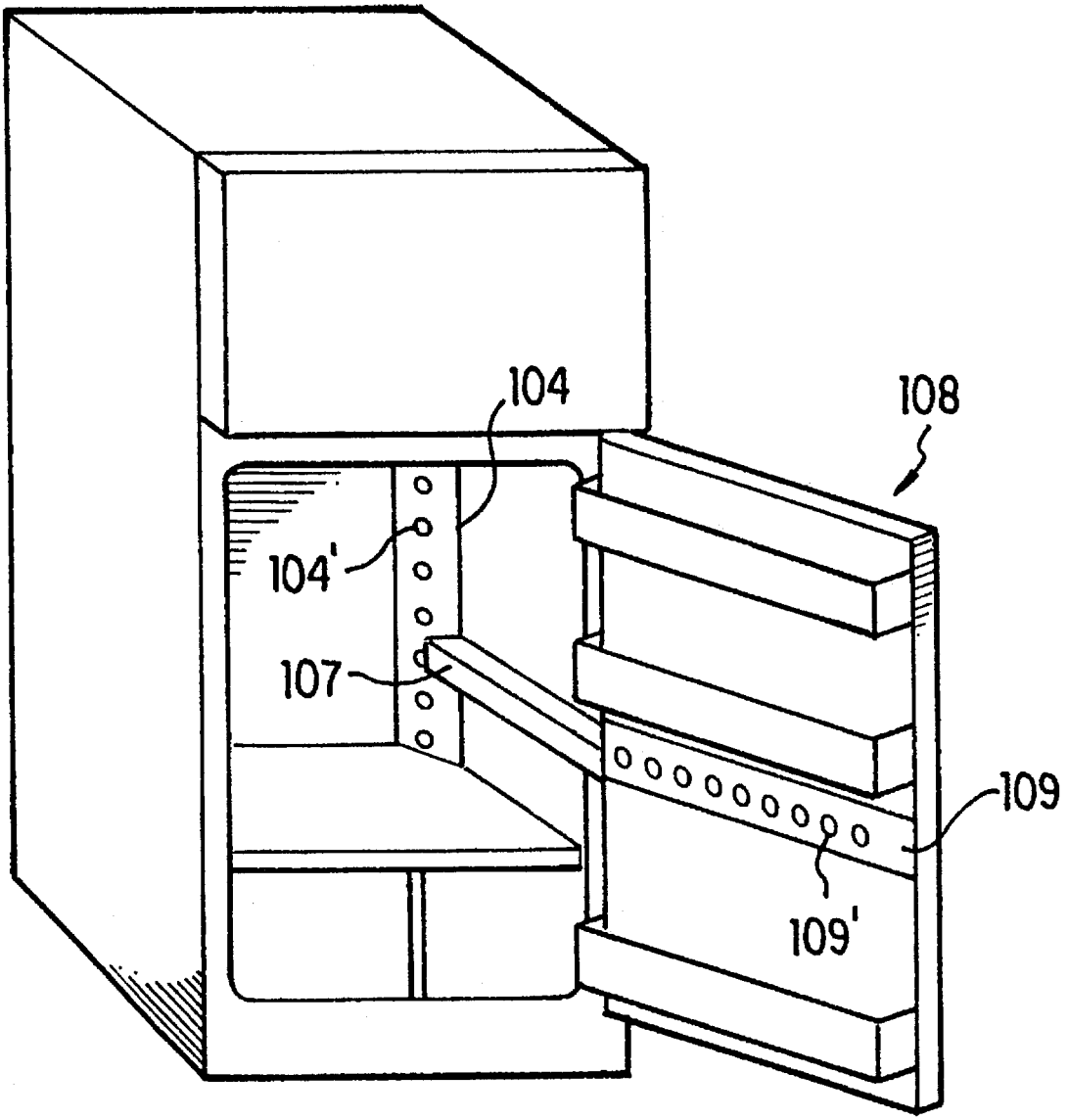
FIG. 4 is a perspective view of a refrigerator for describing a flow of cool air in a cool air, supply apparatus of the present invention.

FIG. 4 is a perspective view of a refrigerator for describing a flow of cool air in a cool air supply apparatus of the present invention.

As shown in the drawing, the present cool air supply apparatus includes a cool air duct 104 formed at the both vertical corners, having multiple spout holes 104' in the front body of it, a transmission duct 107 formed horizontally at the one side wall of the cold-storage room and connected with a certain portion of the above cool air duct 104, for transmitting the cool air of the cool air duct 104, and a door duct 109 formed horizontally at the wall of the door and connected with the above transmission duct 107 through a connecting tube 110, having multiple spout holes 109' for spouting the cool air supplied through the above transmission duct 107 and the connecting tube 110 toward the inside of the cold-storage room.

Figure 5:
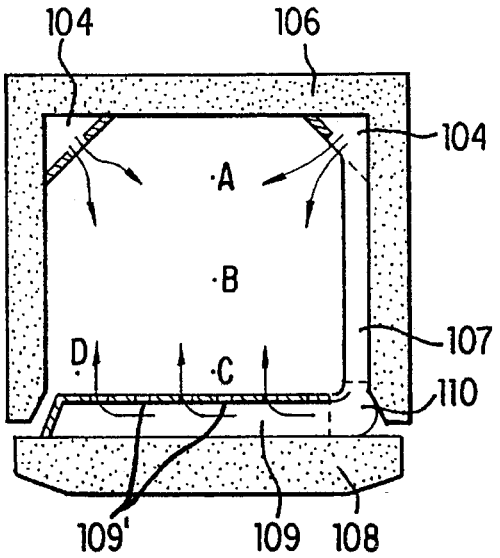
FIG. 5 is a cross-sectional view of the cold-storage room taken along line B—B' line of FIG. 4.
Figure 6:
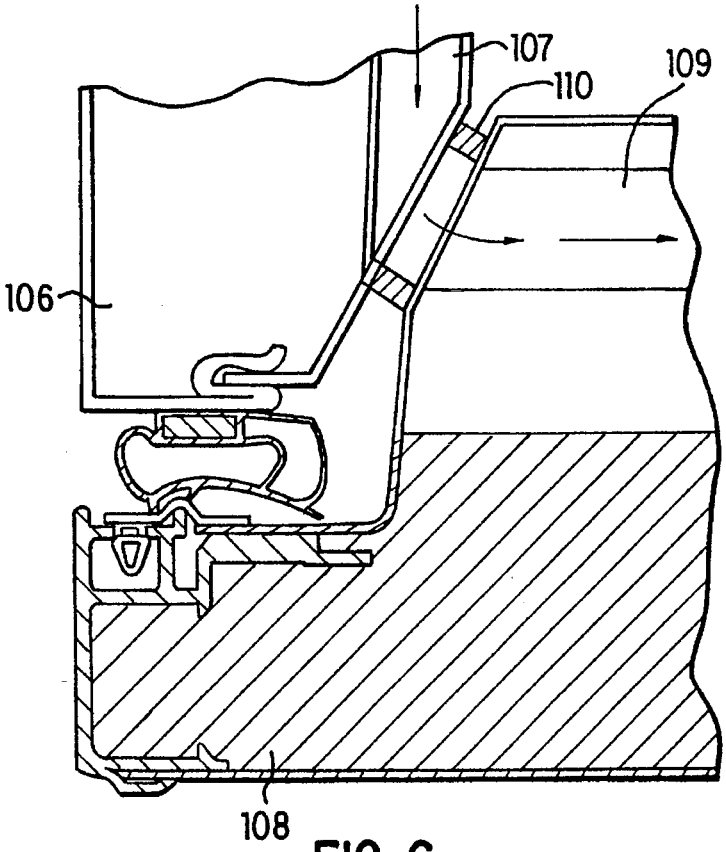
FIG. 6 is a partial detailed view of a connecting tube for connecting a transmission duct with a door duct.

FIG. 5 is a cross-sectional view of the cold-storage room taken along line B—B' line of FIG. 4 and FIG. 6 is a partial detailed view of a connecting tube for connecting a transmission duct with a door duct.

As shown in the drawings, since the door 108 is divided with the main body of the cold-storage room on opening the door 108, the connecting tube 110 connecting the transmission duct 107 with the door duct 109, is made of a material having soft quality so that it prevents a leakage of the cool airs due to the transformation of the connecting tube 110.

Referring to FIG. 4, 5 and 6, there is illustrated a cooling method of the cooling apparatus in accordance with the present invention.

First, cool air generated from the compressor is compulsorily circulated by the fan motor and moved to the cold-storage room through the cool air duct and the guiding duct. The supply quantity of the cool air being introduced to the cold-storage room, is controlled according to the sensing temperature of the temperature sensor. At this time, a part of the cool air supplied to the cool air duct 104 is spouted to the cold-storage room and the rest of them is moved to the door duct 109 through the transmission duct 107 and the connecting tube sequentially. The door duct 110 spouts the supplied cool airs to the inside of the cold-storage room through the spout holes 109' of it.

That is, the cool air supplied from the guiding duct are spouted from not only the spout holes 104' of the cool air duct 104 equipped to the both vertical corners of the cold-storage room but also the spout holes 109' of the door duct 109 equipped to the door portion. Therefore, as shown in FIG. 5, the vicinity C, D of the door 108 in which a heat penetration of the outside is easy, has a same temperature band with the inner portion A, B of the cold-storage room.

As described in detail above, the conventional refrigerator has a long cooling time for arrival of an appropriate cooling temperature because cool air is dispersed from the center portion of wall of the cold-storage room to the door portion. Besides, it has a problem that foods in the vicinity of the door go bad easily because there has a high temperature band compared with the inside of the cold-storage room. But, the present invention can compensate loss of cool air due to the heat penetration of the outside by providing an additional cool airs path at the vicinity of the door and spouting cool air through the spout holes of it. Accordingly, it can become to preserve foods for a long term regardless of the position of foods put in the cold-storage room.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A cool air supply apparatus of a refrigerator comprising a cool air guiding means for guiding cool air flowing from an evaporator, connected to a compressor, to a cold-storage room;

cool air duct means for venting the cool air supplied from the cool air guiding means mounted on surfaces of the walls and door of the cold-storage room;

said cool air duct means comprising:

first duct formed at both vertical corners, for venting a part of the cool air supplied from the evaporator and transmitting the rest of the supplied cool air;

a second duct formed horizontally at one side wall of the cold-storage room and connected with a certain portion of said first duct, for transmitting the cool air introduced from said first duct;

a third duct formed horizontally at the wall of the door for venting the cool air introduced from said second duct; and a connecting tube for transmitting the cool air of said second duct to said third duct.

2. The cool air supply apparatus in accordance with claim 1, wherein said first duct has multiple duct holes for venting the supplied cool air.

3. The cool air supply apparatus in accordance with claim 1, wherein said third duct has multiple duct holes for venting the supplied cool air.

4. The cool air supply apparatus in accordance with claim 1, wherein said connecting tube is made of a material having soft quality for preventing leakage of the cool air due to the movement of the connecting tube.

* * * * *